US006347214B1

(12) United States Patent
Kaneko

(10) Patent No.: US 6,347,214 B1
(45) Date of Patent: Feb. 12, 2002

(54) IMAGE TRANSFERRING DEVICE FOR AN IMAGE FORMING APPARATUS

(75) Inventor: Chiemi Kaneko, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/696,968

(22) Filed: Oct. 27, 2000

(30) Foreign Application Priority Data

Oct. 29, 1999 (JP) ..... 11-308734

(51) Int. Cl.[7] ..... G03G 15/00
(52) U.S. Cl. ..... 399/397; 399/315; 399/316
(58) Field of Search ..... 399/303, 310, 399/311, 312, 313, 314, 315, 316, 397, 398, 400, 404; 271/306, 307, 311

(56) References Cited

U.S. PATENT DOCUMENTS

| | | | | |
|---|---|---|---|---|
| 5,923,936 A | * | 7/1999 | Tanoue et al. | 399/297 |
| 5,950,062 A | | 9/1999 | Yahata et al. | 399/358 |
| 6,085,064 A | * | 7/2000 | Nagase et al. | 399/400 X |
| 6,173,148 B1 | | 1/2001 | Matsuda et al. | 399/310 |

FOREIGN PATENT DOCUMENTS

| | | |
|---|---|---|
| JP | 7-13439 | 1/1995 |
| JP | 7-261562 | 10/1995 |
| JP | 9-218623 | 8/1997 |
| JP | 11-84903 | 3/1999 |

* cited by examiner

*Primary Examiner*—Sandra Brase
*Assistant Examiner*—Hoan Tran
(74) *Attorney, Agent, or Firm*—Oblon, Spivak, McClelland, Maier & Neustadt, P.C.

(57) ABSTRACT

An image transferring device for an image forming apparatus and of the type using a belt formed of a dielectric material includes a guide member for guiding a recording medium, which carries a toner image transferred thereto from an image carrier. The guide member is formed with holes spaced from each other in the widthwise direction of the recording medium. A discharging member is received in the holes and has discharge needles. The discharging member is positioned such that the tips of the discharge needles do not contact the recording medium. The guide member includes a center guide portion, opposite end guide portions, and recess portions each connecting the center guide portion and one of the end guide portions. Ribs are formed at stepped portions existing between the center guide portion and the recess portions and between the recess portions and the end guide portions, preventing the holes from catching the recording medium. The guide member guides the recording medium separated from the belt toward a fixing unit while electrostatically attracting the medium.

10 Claims, 3 Drawing Sheets

IMAGE TRANSFERRING DEVICE FOR AN IMAGE FORMING APPARATUS

BACKGROUND OF THE INVENTION

The present invent ion relates to a copier, printer, facsimile apparatus or similar image forming apparatus and more particularly to an image transferring device for an image forming apparatus of the type using a belt formed of a dielectric material.

An image transferring device of the type described includes an endless belt formed of a dielectric material and a charging member for charging the belt. While the charging member charges the belt, a drive source causes the belt to run so as to convey a paper sheet or similar recording medium. In this condition, a toner image formed on an image carrier is transferred to the paper sheet. The belt conveys the paper sheet while electrostatically attracting it. A guide member guides the paper sheet separated from the belt toward a fixing unit.

A problem with the above-described configuration is that when the paper sheet carrying the toner image is separated from the belt, potential sharply rises due to a change in the gap between the charged paper sheet and the belt, resulting in peel discharge. The peel discharge disturbs the toner image, which is not fixed, and causes the toner to fly about and render the toner image defective. Discharge also occurs when the paper sheet is being conveyed along the guide member and when the former is separated from the latter. As a result, the toner contaminates the guide member and deposits on the rear or the edge portions of the next paper sheet by way of the guide member.

In light of the above, Japanese Patent Laid-Open Publication No. 6-317990 (Prior Art 1), for example, proposes an arrangement for absorbing the slack of a paper sheet ascribable to a difference in linear velocity between a fixing unit and a belt. In the proposed arrangement, a guide member has a guide surface thereof formed of a conductive material while a discharge brush is positioned at the outlet of the guide member for efficiently discharging a recording medium.

Japanese Patent Laid-Open Publication No. 6-180538 (Prior Art 2) discloses an image transferring device configured to reduce a change in the volume resistivity of the belt and a change in the volume resistivity of a guide member, thereby reducing the variation of an electric field. A plurality of ribs extend on the guide surface of the guide member in a direction in which the guide member guides a paper sheet (direction of guide hereinafter). Even when toner smears the guide member, the ribs prevent the paper sheet from directly contacting the smeared part of the guide member.

Prior Art 1 has a problem that the discharge brush excessively discharges a paper sheet at the outlet of the guide member and thereby obstructs electric attraction expected to act on the paper sheet at a fixation inlet guide member following the above guide member. Consequently, when the leading edge of the paper sheet enters the nip of a fixing unit while the trailing edge of the same is conveyed by the belt, the paper sheet is apt to warp at the position of the discharge brush due to a difference in linear velocity between the fixing unit and the belt. This brings about a defective image ascribable to discharge. Prior Art 2 exhibits a discharging effect not as great as one achievable with, e.g., a discharge brush and causes defects to appear on the toner image at the pitch of the ribs when the paper sheet is separated from the guide member.

As stated above, in the conventional image transferring devices, the discharge disturbs paper transfer if excessive or makes a toner image defective due to discharge if short.

To solve the above problem, Japanese Patent Application No. 11-254370 (Prior Art 3), for example, teaches an image transferring device including a guide member and a discharging member positioned at the intermediate portion of the guide member in the direction of guide. Specifically, the guide member is formed with holes open at its guide surface. The discharging member is received in the holes. With this configuration, the device is capable of stably conveying a paper sheet while causing the guide member electrostatically attracting the paper sheet. At the same time, the paper sheet is discharged and therefore suffers from a minimum of image deterioration ascribable to discharge that occurs at a position following the guide member.

However, Prior Art 3 has a drawback that the edges of the holes open at the guide or conveyance surface of the guide member are apt to catch the leading edge of a paper sheet, disturbing the conveyance of the paper sheet or causing the paper sheet to jam the path. Further, when the leading edge of the paper sheet caught by the edges of the holes rebounds, the resulting shock is likely to disturb and deteriorate a toner image carried on the paper sheet. Moreover, the holes, receiving the discharging member therein, lowers the mechanical strength of the guide member.

Technologies relating to the present invention are also disclosed in, e.g., Japanese Patent Laid-Open Publication Nos. 7-13439, 7-261562, 9-218623 and 11-84903.

SUMMARY OF THE INVENTION

It is therefore an object of the present invention to provide an image transferring device capable of insuring the conveyance of a paper sheet despite the presence of holes, obviating defective images ascribable to discharge to occur at a position following a guide member, and preventing the mechanical strength of the guide member from decreasing.

An image transferring device of the present invention includes a belt for conveying a recording medium, which carries an image transferred thereto from an image carrier, while electrostatically attracting the medium. A charging device applies a charge to the belt. A belt drive source causes the belt to run. A guide member guides the recording medium separated from the belt. A plurality of holes are formed in the intermediate portion of the guide member in a direction of guide and open at the guide surface of the guide member. A discharging member is received in the plurality of holes. A plurality of ribs extend on the guide surface of the guide member in the direction of guide in such a manner as to bridge the edges of adjoining ones of the plurality of holes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
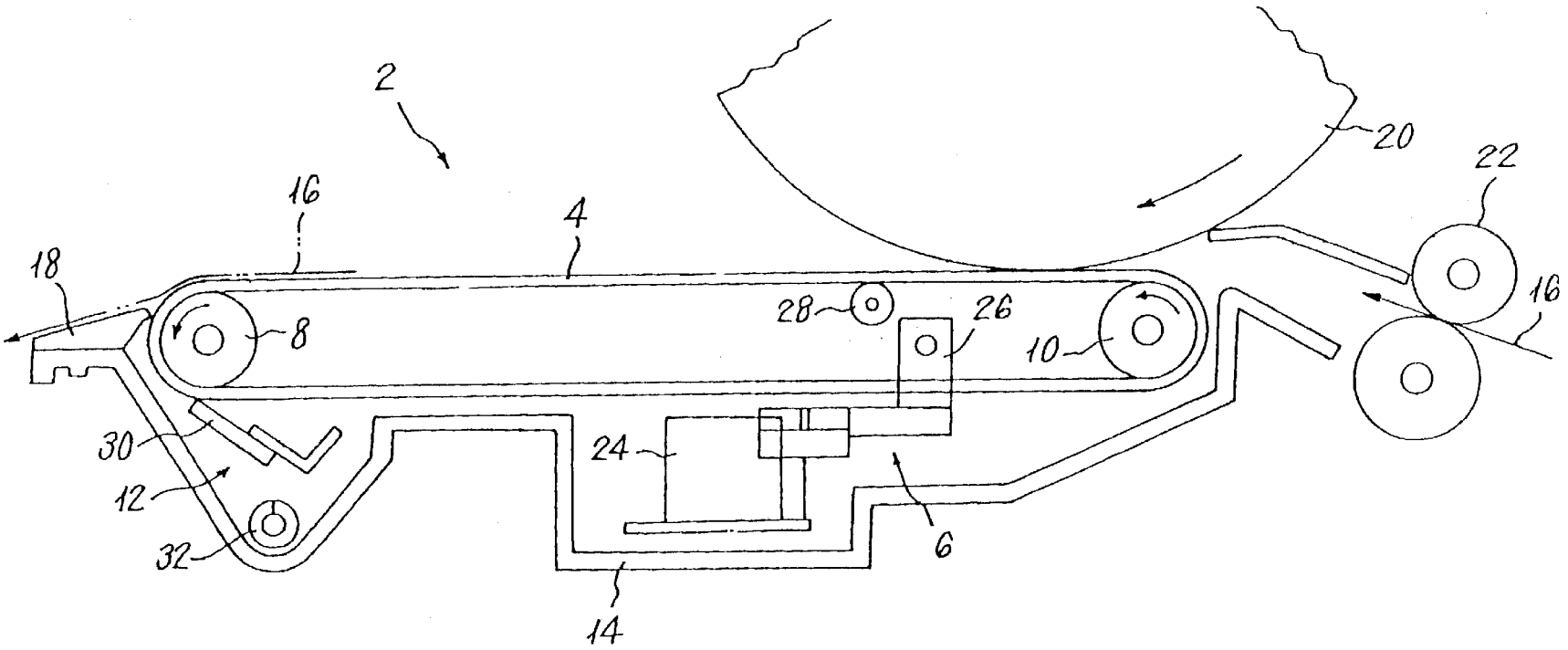
FIG. 1 is a front view showing an image transferring device embodying the present invention.

Referring to FIG. 1 of the drawings, an image transferring device embodying the present invention is shown and generally designated by the reference numeral 2. As shown, the image transferring device 2 includes an endless belt 4 formed of a dielectric material. A charging device 6 applies a charge for image transfer to the belt 4. The belt 4 is passed over a drive roller 8 and a driven roller 10 that constitute belt drive means in combination. A cleaning unit 12 cleans the surface of the belt 14. A guide member 18 guides a paper sheet or similar recording medium 16 separated from the belt 4 toward a fixing unit not shown.

The belt 4 contacts an image carrier implemented as a photoconductive drum 20 at an image transfer position, forming a nip between the belt 4 and the drum 20. After a main charger has uniformly charged the surface of the drum 20 to preselected polarity, an exposing unit scans the charged surface of the drum 20 to thereby electrostatically form a latent image thereon, although not shown specifically. A developing unit, not shown, develops the latent image with toner so as to form a corresponding toner image on the drum 20.

The paper sheet 16 is fed from a paper feeding section, not shown, included in an image forming apparatus to a registration roller pair 22. The registration roller pair 22 conveys the paper sheet 16 to the nip between the drum 20 and the belt 4 at such a timing that the leading edge of the paper sheet 16 meets the leading edge of the toner image formed on the drum 20.

The belt 4 is made up of a base layer and a surface layer covering the base layer. The base layer is formed of elastic rubber having a medium resistance. The surface layer of the belt 4 is implemented by a fluorine-containing material that provides the belt 4 with a coefficient of surface friction low enough to be stably cleaned by the cleaning unit 12. For example, polyvinylidene fluoride or tetrafluoroethylene containing a dispersant covers the surface of the belt 4 to a thickness of $5\mu$ to $15\mu$. The belt 4 has a specific surface resistivity (prescribed by JIS (Japanese Industrial Standards) K691) ranging from 1×10E10 Ω to 1×10E12 Ω. For the base layer covered with the surface layer, use is made of chloroprene rubber, EPDM rubber, epichlorohydrin rubber or similar rubber or a mixture thereof. Carbon, metal oxide or similar conductive rubber may be introduced in such rubber in order to control the resistance, as needed. The specific surface resistance (JIS K691) of the base layer should preferably be between 1×10E7 Ω and 5×10E9 Ω.

The drive roller 8 is made up of a metallic core and a rubber layer covering the core and is in an electrically floating state. The driven roller 10 is formed of metal and plays the role of a feedback roller for feeding back a current, which does not flow from the belt 4 to the drum 20, at the same time. A drive source, not shown, causes the drive roller 8 to rotate in a direction indicated by an arrow in FIG. 1. The outer surface of the drive roller 8 and the inner surface of the belt 4, both of which are implemented by rubber, exert a high coefficient of friction, so that the rotation of the drive roller 8 is surely transferred to the belt 4 without any slip. The driven roller 10 is caused to rotate by the belt 4.

The charging device 6 includes a high-tension power source 24, a bias terminal 26, and a bias roller 28 for image transfer. The bias roller 28 is connected to the high-tension power source 24 via the bias terminal 26. The bias roller 28 is held in contact with the inner surface of the belt 4 at a position downstream of the nip between the belt 4 and the drum 20 in the direction of rotation of the belt 4. The bias roller 24 is formed of metal prescribed by, e.g., SUS (JIS).

The charging device 6 additionally includes a current control section not shown. The current control section causes the high-tension power source 24 to apply a bias for image transfer to the bias roller 28. At the same time, the current control section compares a current $I_1$ to flow from the power source 24 to the belt 4 via the bias roller 28 and a current $I_2$ to be fed back via the belt 4 without flowing from the belt 4 to the drum 20. The current control section controls the output of the power source 24 such that the resulting difference $(I_1-I_2)$ has a preselected value K. This successfully maintains the current to flow from the belt 4 to the drum 20 constant (substantially K) and thereby allows the toner image to be stably transferred to the paper sheet 16 at all times. If desired, the function of the current control section may be assigned to a main controller, not shown, included in the image forming apparatus in which the image transferring device 2 is arranged.

The cleaning unit 12 includes a cleaning blade 30 and a collecting member implemented as a screw 32. The cleaning blade 30 is held in contact with the outer surface of the belt 4 for scraping off toner and other impurities left on the belt 4 after image transfer. The screw 32 collects the toner and other impurities dropped from the cleaning blade 30 to the bottom of a casing 14.

Figure 2:
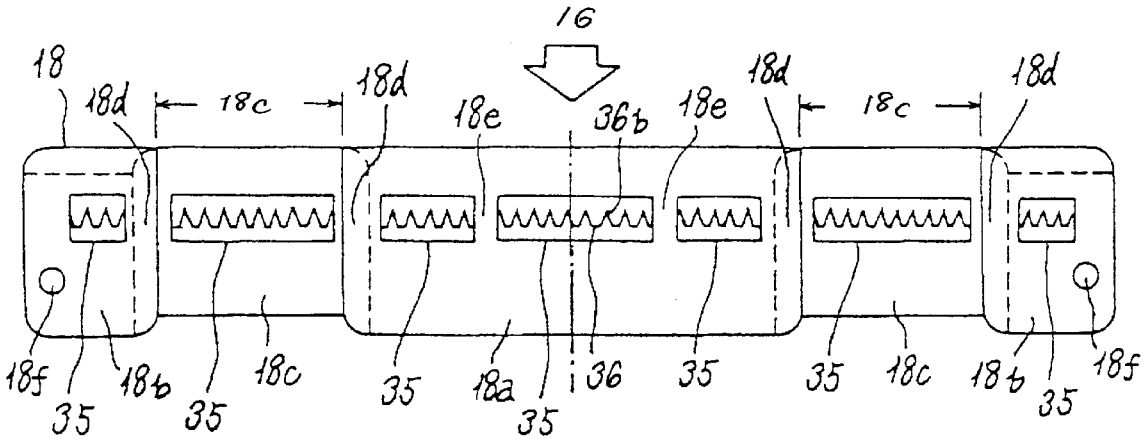
FIG. 2 is a plan view showing a specific configuration of a guide member included in the illustrative embodiment.
Figure 3:
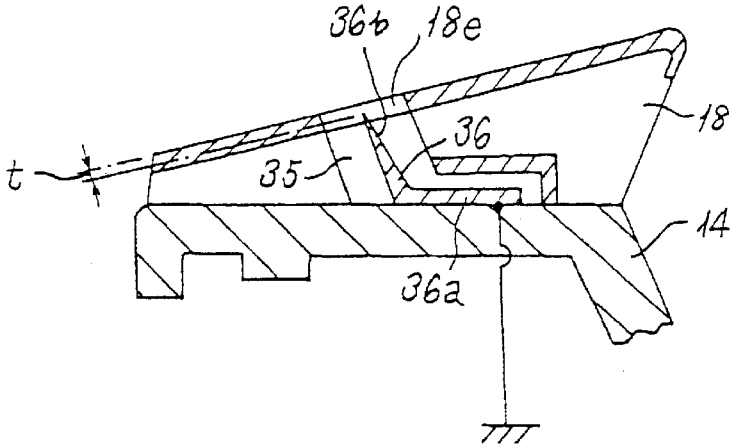
FIG. 3 is a sectional view of the guide member.
Figure 4:
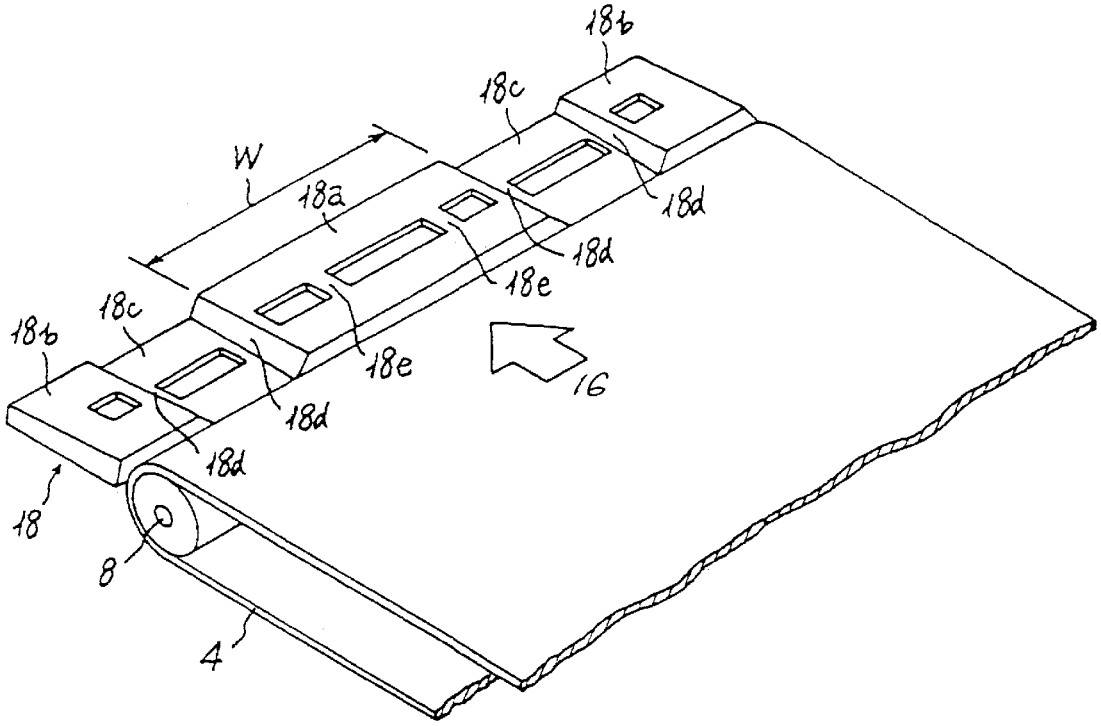
FIG. 4 is an isometric view of the guide member.

Reference will be made to FIGS. 2 through 4 for describing a specific configuration of the guide member 18. As shown, the guide member 18 includes a center guide portion 18*a*, a pair of end guide portions 18*b*, and a pair of recess portions 18*c* each connecting the center guide portion 18*a* and one of the end guide portions 18*b*. Holes 35 are formed in the intermediate portion of the guide member 18 while a discharging member 36 is received in the holes 35. Stepped portions are formed between the recess portions 18*c* and the center portion 18*a* and between the recess portions 18*c* and the end guide portions 18*b* perpendicularly to a direction in which the guide member 18 guides the paper sheet 16 (direction of guide hereinafter). Ribs 18*d* are positioned at the above stepped portions and extend in the direction of guide in such a manner as to bridge the edges of the holes 35. In addition, the center guide portion 18*a* is formed with ribs 18*e* extending in the direction of guide while bridging the edges of the holes 35.

As shown in FIG. 4, the center guide portion 18*a* has a width W smaller than the width of the minimum paper width applicable to the image forming apparatus, so that toner scattered from opposite side edges of the paper sheet 16 does not deposit on the guide portion 18*a*. So long as the paper sheet 16 is not of a large size, it is supported by the center guide portion 18*a* and has its opposite edge portions positioned in and guided by the recess portions 18*c* without contacting them. Should the holes 35 extend to the stepped portions of the guide member 18, i.e., be contiguous with each other, the edges of the holes 35 would easily catch the opposite edges of the paper sheet 16, which slightly hang down into the recess portions 18*c*. In the illustrative embodiments, the ribs 18*d* extending in the direction of guide do not catch the side edges of the paper sheet 16 at all. In addition, the ribs 18*e* formed on the center guide portion 18*a* do not catch the side edges of the paper.

Further, the ribs 18*d* and 18*e* not only insures reliable paper conveyance, but also provide the guide member 18 with sufficient mechanical strength despite the presence of the holes 35. Moreover, the ribs 18*d* and 18*e* are positioned symmetrically to each other in the right-and-left direction with respect to the center of the guide member 18. In this condition, the ribs 18*d* and 18*e* exert resistance (friction) to the conveyance of the paper sheet 16 symmetrically in the above direction. The guide member 18 can therefore surely guide the paper sheet 16 by protecting it from, e.g., a turning moment that would disturb the position of the paper sheet 16.

The guide member 18 may be formed of resin having a medium resistance, e.g., antistatic ABS (Acrylonitrile-Butadiene-Styrene) resin or a mixture of polycarbonate and ABS resin. The guide member 18 has a volume resistivity ranging from 1×10E8 Ωcm to 1×10E13 Ωcm, which is close to the resistivity of the belt 4.

The discharging member 36 is formed of stainless steel and includes a base portion 36*a* extending in the lengthwise direction of the guide member 18. A number of discharge needles 36*b* rise obliquely upward from the base 36*a*. In the illustrative embodiment, the discharge needles 36*b* are arranged at a pitch of 2 mm.

As shown in FIG. 3, the base 36*b* is connected to ground via the housing of the apparatus, not shown. The tip of each discharge needle 36*b* is spaced from the guide surface of the guide member 18 by a distance t of at least 0.5 mm, so that the tip does not directly contact the paper sheet 16 being guided by the guide member 18. The discharge member 36 therefore does not exert any resistance to the conveyance of the paper sheet 16 or discharge the paper sheet 16 to an excessive degree.

As shown in FIG. 2, the guide member 18 is formed with screw holes 18*f* in opposite ends thereof. Screws, not shown, are driven into the casing 14, FIG. 1, via the screw holes 18*f* in order to affix the guide member 18 to the casing 14. The discharging member 36 is not shown FIG. 4.

In operation, when the paper sheet 16 separated from the belt 4 is guided by the guide member 18, an attracting force acts between the paper sheet 16, which is charged, and the guide member 18 having a medium resistance due to electrostatic induction. As a result, the paper sheet 16 is conveyed along guide member 18 in contact with the center guide portion 18*a*. Subsequently, the discharging member 36 discharges the paper sheet 16 with the discharge needles 36*b*. At this instant, the discharging member 36 does not cause an electric field to sharply vary because it discharges the paper sheet 16 over a broad range with the needles 36*b*, which are spaced from the paper sheet 16 by the distance t.

Although the discharging member 36 is connected ground, its charging efficiency is lower than the charging efficiency of the conventional discharge needles applied with a DC bias, which is opposite in polarity to the bias for image transfer. Therefore, the paper sheet 16 is continuously conveyed along the guide member 18 with some charge left thereon. Consequently, the electrostatic attracting force continuously acts between the paper sheet 16 and the guide member 18, insuring the stable conveyance of the paper sheet 16 until it moves away from the guide member 18. Further, when the paper sheet 16 moves away from the guide member 18, a sharp change in electric field does not occur because the paper sheet 16 has been discharged by the discharging member 36 to a certain degree. This is successful to prevent toner from flying about and rendering the toner image carried on the paper sheet 16 defective.

The arrangement including the discharging member 36 connected to ground is simpler than the conventional arrangement that applies a DC bias opposite in polarity to the bias for image transfer to discharge needles. In addition, when the bias is of positive polarity, it is possible to reduce the amount of ozone to be produced by the entire image transferring device.

In the illustrative embodiment, the guide member 18 is formed of a material having a medium resistance. If desired, the material having a medium resistance may be coated with an insulating material or may be implemented as a double layer including an insulating layer. Such alternative configurations also insure the stable conveyance of the paper sheet 16 by using electrostatic attraction. Further, the guide member 18 may be implemented by a conductive material and a material having a medium resistance and an insulating material laminated thereon.

The recess portions 18*c* included in the guide member 18 are not essential and may be omitted, in which case the ribs 18*a* will be formed symmetrically in the right-and-left direction.

Figure 5:
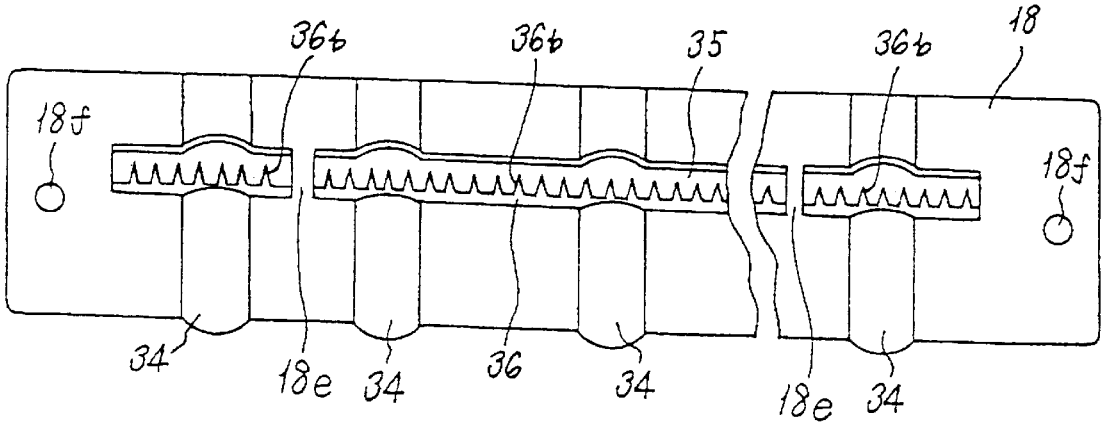
FIG. 5 is a plan view showing another specific configuration of the guide member.

FIG. 5 shows another specific configuration of the guide member 18. As shown, a plurality of ribs 18*e* each having an arcuate cross-section are arranged in the widthwise direction of the paper sheet 16, not shown, in order to raise the paper sheet 16 above the guide surface of the guide member 18. In this configuration, the paper sheet 16 is conveyed along the tops of the ribs 34 and therefore protected from contamination ascribable to toner, which may contaminate the body of the guide member 18.

In summary, it will be seen that the present invention provides an image transferring device for an image forming apparatus having various unprecedented advantages, as enumerated below.

(1) Ribs extend in a direction of guide in such a manner as to bridge the edges of holes that receive a discharging member. The holes are therefore prevented from catching the leading edge of a recording medium and disturbing the conveyance of the medium or from causing the medium to jam a path. Also, a toner image formed on the recording medium is free from deterioration a scribable to a shock that would occur due to the rebound of the medium. In addition, the ribs make up for a decrease in the mechanical strength of a guide member ascribable to the holes.

(2) A discharging member is positioned in the intermediate portion of the guide member in the direction of guide. The recording medium can therefore be stably conveyed by being electrostatically attracted toward the guide member. Also, the discharging member discharges the recording medium and thereby protects the toner image from disturbance ascribable to discharge that may occur on the path downstream of the guide member.

(3) Stepped portions rise from the guide member perpendicularly to the direction of guide. Ribs are positioned at at least the stepped portions. Therefore, in a configuration capable of protecting opposite side edges of the recording medium from contamination, there can be obviated troubles ascribable to the catching of the recording medium.

(4) The ribs are configured and arranged symmetrically in the right-and-left direction with respect to the center of the guide member in the direction of guide. The guide member therefore exerts resistance to the conveyance to the recording medium (friction) symmetrically in the right-and-left direction while guiding the medium, insuring the accurate position of the medium.

Various modifications will become possible for those skilled in the art after receiving the teachings of the present disclosure without departing from the scope thereof.

What is claimed is:

1. An image transferring device comprising:

a belt for conveying a recording medium, which carries an image transferred thereto from an image carrier, while electrostatically attracting said recording medium;

charging means for applying a charge to said belt;

belt drive means for causing said belt to run;

a guide means for guiding the recording medium separated from said belt, wherein a plurality of holes are formed in an intermediate portion of said guide means in a direction of guide and open at a guide surface of said guide means;

a discharging means having a portion thereof that is closest to but not in contact with the recording medium that is received in said plurality of holes for partly discharging the recording medium; and a plurality of ribs extending on said guide surface of said guide means in the direction of guide in such a manner as to bridge edges of adjoining ones of said plurality of holes.

2. A device as claimed in claim 1, wherein said plurality of ribs are configured and arranged symmetrically in a right-and-left direction with respect to a center of said guide means in the direction of guide.

3. A device as claimed in claim 1, wherein the discharging means is conductive and directly connected to ground.

4. An image transferring device comprising:

a belt for conveying a recording medium, which carries an image transferred thereto from an image carrier, while electrostatically attracting said recording medium;

charging means for applying a charge to said belt;

belt drive means for causing said belt to run;

a guide means for guiding the recording medium separated from said belt, wherein a plurality of holes are formed in an intermediate portion of said guide means in a direction of guide and open at a guide surface of said guide means;

a discharging means received in said plurality of holes; and a plurality of ribs extending on said guide surface of said guide means in the direction of guide in such a manner as to bridge edges of adjoining ones of said plurality of holes, wherein a plurality of stepped portions are formed on said guide means perpendicularly to the direction of guide, and wherein said plurality of ribs are positioned at at least said plurality of stepped portions.

5. A device as claimed in claim 4, wherein said plurality of ribs are configured and arranged symmetrically in a right-and-left direction with respect to a center of said guide means in the direction of guide.

6. An image transferring device comprising:

a belt configured to convey a recording medium, which carries an image transferred thereto from an image carrier, while electrostatically attracting said recording medium;

a charging device configured to apply a charge to said belt;

a belt drive source configured to cause said belt to run;

a guide member configured to guide the recording medium separated from said belt, wherein a plurality of holes are formed in an intermediate portion of said guide member in a direction of guide and open at a guide surface of said guide member;

a discharging member having a portion thereof that is closest to but not in contact with the recording medium that is received in said plurality of holes and configured to partly discharge the recording medium; and a plurality of ribs extending on said guide surface of said guide member in the direction of guide in such a manner as to bridge edges of adjoining ones of said plurality of holes.

7. A device as claimed in claim 6, wherein said plurality of ribs are configured and arranged symmetrically in a right-and-left direction with respect to a center of said guide member in the direction of guide.

8. A device as claimed in claim 6, wherein the discharging member is conductive and directly connected to ground.

9. An image transferring device comprising:

a belt configured to convey a recording medium, which carries an image transferred thereto from an image carrier, while electrostatically attracting said recording medium;

a charging device configured to apply a charge to said belt;

a belt drive source configured to cause said belt to run;

a guide member configured to guide the recording medium separated from said belt, where in a plurality of holes are formed in an intermediate portion of said guide member in a direction of guide and open at a guide surface of said guide member;

a discharging member received in said plurality of holes; and a plurality of ribs extending on said guide surface of said guide member in the direction of guide in such a manner as to bridge edges of adjoining ones of said plurality of holes, wherein said plurality of ribs are configured and arranged symmetrically in a right-and-left direction with respect to a center of said guide member in the direction of guide, wherein a plurality of stepped portions are formed on said guide member perpendicularly to the direction of guide, and wherein said plurality of ribs are positioned at at least said plurality of stepped portions.

10. A device as claimed in claim 9, wherein said plurality of ribs are configured and arranged symmetrically in a right-and-left direction with respect to a center of said guide member in the direction of guide.

* * * * *